US008941702B2

(12) United States Patent
Fukaya

(10) Patent No.: US 8,941,702 B2
(45) Date of Patent: Jan. 27, 2015

(54) ERASING APPARATUS AND ERASING METHOD

(71) Applicants: Kabushiki Kaisha Toshiba, Minato-ku, Tokyo (JP); Toshiba Tec Kabushiki Kaisha, Shinagawa-ku, Tokyo (JP)

(72) Inventor: Hideaki Fukaya, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/900,737

(22) Filed: May 23, 2013

(65) Prior Publication Data

US 2014/0055545 A1 Feb. 27, 2014

(30) Foreign Application Priority Data

Aug. 24, 2012 (JP) ..... 2012-185178

(51) Int. Cl.

| | |
|---|---|
| ***B41J 2/325*** | (2006.01) |
| ***B41J 13/00*** | (2006.01) |
| ***B41J 2/32*** | (2006.01) |
| *B41J 15/10* | (2006.01) |
| *B41J 29/16* | (2006.01) |
| *B41J 11/60* | (2006.01) |
| *B41J 29/00* | (2006.01) |
| *B41J 29/36* | (2006.01) |

(52) U.S. Cl.

CPC ..... *B41J 13/0009* (2013.01); *B41J 2/32* (2013.01); *B41J 2202/37* (2013.01)

USPC ..... 347/179; 400/695; 400/696; 400/697; 400/698; 400/699; 400/700

(58) Field of Classification Search

CPC ..... B41J 11/60; B41J 13/0009; B41J 29/26; B41J 29/28; B41J 29/32; B41J 29/36; B41J 29/367; B41J 29/373; B41J 2002/4756; B41J 2202/37; B43L 19/00; B43L 19/0043; B65H 37/007

USPC ..... 347/179; 400/695–700

See application file for complete search history.

(56) References Cited

U.S. PATENT DOCUMENTS

| | | | | |
|---|---|---|---|---|
| 4,980,719 | A * | 12/1990 | Allen et al. | 399/3 |
| 5,612,766 | A * | 3/1997 | Iida et al. | 399/23 |
| 2009/0154970 | A1 * | 6/2009 | Yoshida et al. | 399/341 |

(Continued)

FOREIGN PATENT DOCUMENTS

| | | |
|---|---|---|
| JP | 2000-255909 | 9/2000 |
| JP | 2010-113337 | 5/2010 |

OTHER PUBLICATIONS

Japanese Office Action for Japanese Patent Application No. 2012-185178 mailed on Jun. 3, 2014.

*Primary Examiner* — Laura Martin
*Assistant Examiner* — Jeremy Bishop
(74) *Attorney, Agent, or Firm* — Amin, Turocy & Watson, LLP

(57) ABSTRACT

In accordance with one embodiment, an erasing apparatus includes a paper feed tray configured to feed a sheet, a reading unit configured to read an image on the sheet, an erasing unit configured to erase the image on the sheet, a cutting apparatus configured to cut the sheet allowed to be cut, a reject box configured to accumulate the sheet which is judged to be not-reusable and a control unit configured to judge the category of the sheet based on the output of the reading unit and change the conveyance destination of the sheet according to the category of the sheet.

5 Claims, 3 Drawing Sheets

(56) References Cited

U.S. PATENT DOCUMENTS

2010/0118361 A1 5/2010 Iguchi
2011/0234721 A1 9/2011 Endo
2011/0310422 A1* 12/2011 Hagiwara ..... 358/1.13

* cited by examiner

ERASING APPARATUS AND ERASING METHOD

CROSS-REFERENCE TO RELATED APPLICATION

This application is based upon and claims the benefit of priority from Japanese Patent Application No. 2012-185178, filed Aug. 24, 2012, the entire contents of which are incorporated herein by reference.

FIELD

Embodiments described herein relate to an erasing apparatus and an erasing method.

BACKGROUND

From a viewpoint of saving resource, an erasing apparatus erasing a developer image by heating a record medium forming image using an erasable developer is put to practical use.

However, in a condition that a manuscript or base paper, a confidential document and the like, which are not expected to be erased, are mixed in the thrown record medium, a conventional erasing apparatus indiscriminately carries out erasing processing with other record medium.

Particularly, a condition that an erased character can be distinguished also exists for the confidential document, and therefore, when the confidential document is processed as a reusable document, the confidential disclosure possibly occurs.

DETAILED DESCRIPTION

In accordance with one embodiment, an erasing apparatus includes a paper feed tray configured to feed a sheet, a reading unit configured to read an image on the sheet, an erasing unit configured to erase the image on the sheet, a cutting apparatus configured to cut the sheet allowed to be cut, a reject box configured to accumulate the sheet which is judged to be not-reusable and a control unit configured to judge the category of the sheet based on the output of the reading unit and change the conveyance destination of the sheet according to the category of the sheet.

Hereinafter, one embodiment of the erasing apparatus and an erasing method is described in detail with reference to accompanying drawings.

Figure 1:
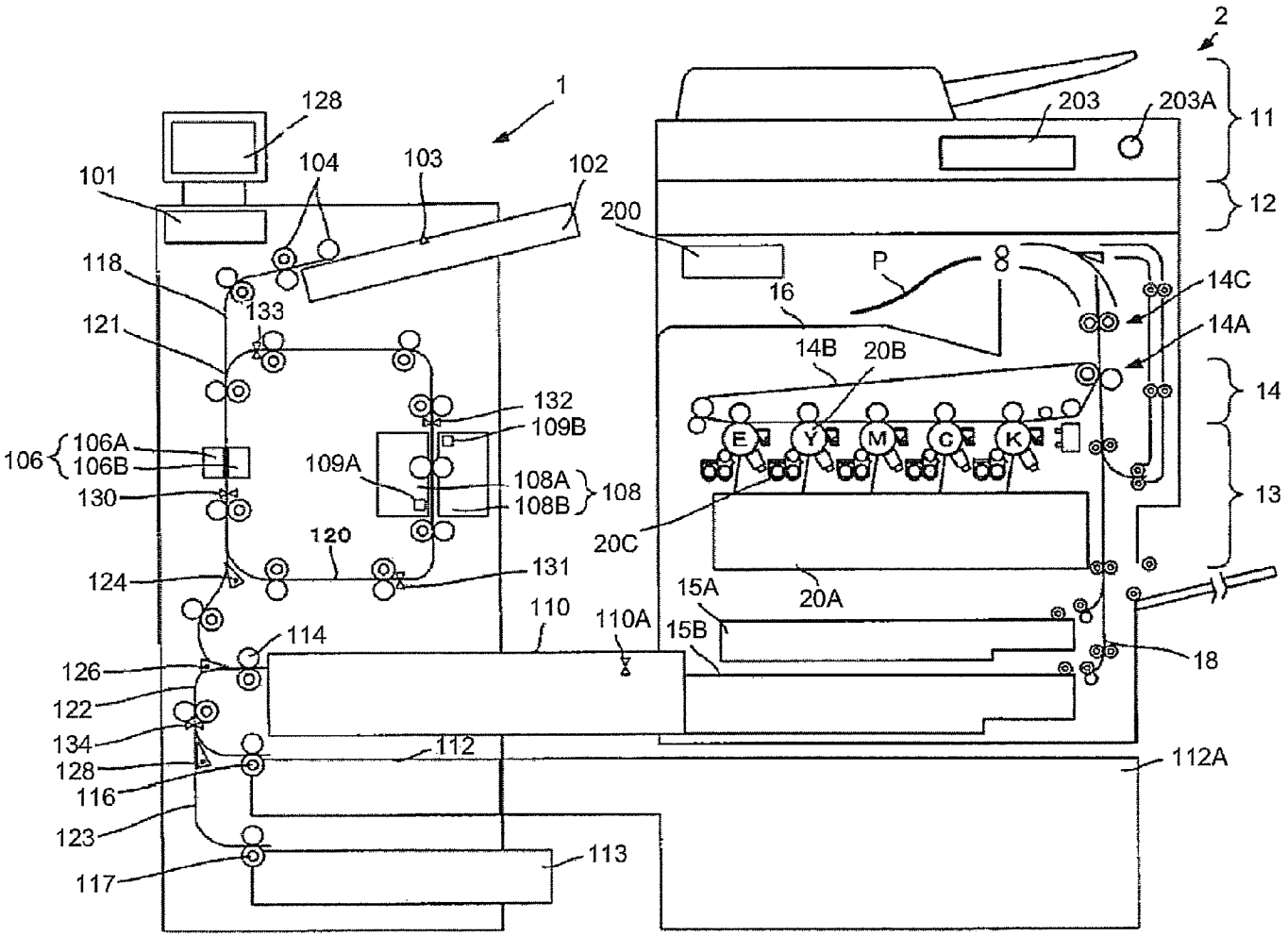
FIG. 1 is a configuration diagram illustrating an erasing apparatus.

FIG. 1 is a configuration diagram illustrating an erasing apparatus 1 of the present embodiment. As shown in FIG. 1, the erasing apparatus 1 comprises: a paper feed tray 102 configured to feed sheet; a reading unit 106 configured to read the image on the sheet; an erasing unit 108 configured to erase the image on the sheet; a connection apparatus 110 configured to convey the sheet judged to be reusable to a paper feed unit 15B of an image forming apparatus 2; a cutting apparatus 112 configured to cut the sheet allowed to be cut; a reject box 113 configured to accumulate the sheet which is judged to be not-reusable; an operation unit 128 configured to be used as an input and output apparatus; and a control unit 101 configured to judge the category of the sheet based on the output of the reading unit 106 and change the conveyance destination of the sheet according to the category of the sheet.

Manuscript, confidential document and not-reusable sheet are included in the category of the sheet.

The paper feed tray 102 carries the sheet subjected to erasing processing. The paper feed tray 102 comprises a paper feed component 104. The paper feed component 104 feeds the sheet on the paper feed tray 102 one by one to a first conveyance path 118 inside the erasing apparatus 1.

In addition, the paper feed tray 102 also comprises a detection sensor 103 detecting the existence of the sheet on the paper feed tray 102.

The first conveyance path 118 forms a conveyance path carrying out conveyance from the paper feed tray 102 to the connection apparatus 110. The first conveyance path 118 conveys the fed sheet to the reading unit 106 or the connection apparatus 110.

The reading unit 106 is configured at the downstream side of the sheet conveyance direction of the paper feed tray 102 along the first conveyance path 118. The reading unit 106, for example, comprises a CCD (Charge Coupled Device) scanner or a sensor such as a CMOS sensor and the like.

The reading unit 106 comprises a first reading unit 106A and a second reading unit 106B, which are configured along the first conveyance path 118, and furthermore, in a status of clamping the conveyance path, and reads double faces of the conveyed sheet.

Figure 2:
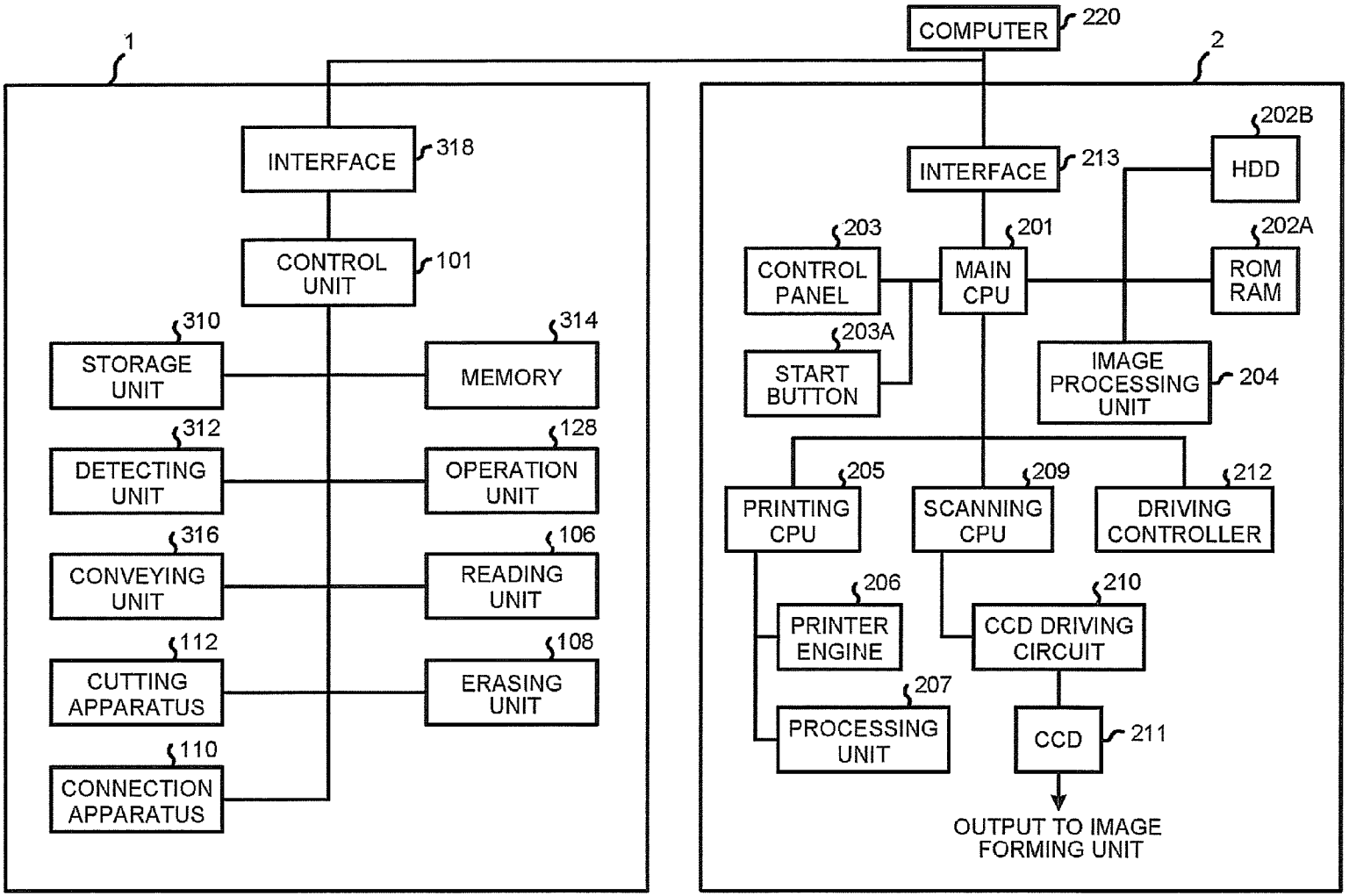
FIG. 2 is a block diagram illustrating configurations of the erasing apparatus.

The erasing apparatus 1 stores the image read by the reading unit 106 in a following storage unit 310 (referring to FIG. 2).

The erasing apparatus 1 comprises a first bifurcating component 124 as a switching unit at the downstream side of the reading unit 106.

The first bifurcating component 124 switches the conveyance direction of the conveyed sheet. The first bifurcating component 124 conveys the sheet conveyed in the first conveyance path 118 to a second conveyance path 120 or the connection apparatus 110.

The second conveyance path 120 is bifurcated from the first conveyance path 118 at a bifurcation point where the first bifurcating component 124 is configured. The second conveyance path 120 bifurcating at the bifurcation point conveys the sheet to the erasing unit 108. In addition, the second conveyance path 120 is converged with the first conveyance path 118 at a convergence point 121 approaching the upstream side of the sheet conveyance direction more than the reading unit 106. Namely, the second conveyance path 120 is converged with the first conveyance path 118 at the convergence point 121 between the paper feed tray 102 and the reading unit 106.

Therefore, the second conveyance path 120 again conveys the sheet conveyed from the reading unit 106 to the reading unit 106 through the erasing unit 108.

The erasing unit 108 erases the color of the image of the conveyed sheet. For example, the erasing unit 108 erases the color of the image formed on the sheet by a recording material by heating the sheet to a specified color erasing temperature in a status of being in contact with the conveyed sheet.

The erasing unit 108 comprises two color erasing units 108A and 108B of a color erasing unit for erasing the color of the first face of the sheet and a color erasing unit for erasing the color of the second face of the sheet. The color erasing units 108A and 108B are oppositely configured in a status of clamping the second conveyance path 120.

The erasing unit 108 respectively comprises temperature sensors 109A and 109B detecting the temperatures of heating units of the color erasing units 108A and 108B. The temperature sensors 109A and 109B can be also touch temperature sensors, and can be also non-touch temperature sensors.

The first conveyance path 118 comprises a second bifurcating component 126 at the downstream side of the first bifurcating component 124. The second bifurcating component 126 guides the sheet conveyed from the first bifurcating component 124 to the connection apparatus 110 or a third conveyance path 122.

The third conveyance path 122 conveys the sheet allowed to be cut to the cutting apparatus 112.

A fourth conveyance path 123 conveys the sheet which is judged to be not-reusable to the reject box 113.

The operation unit 128 configured at the upper portion of a main body of the erasing apparatus 1 comprises a touch panel type display unit and various operation keys.

Discharging components 114, 116 and 117 discharge the sheet to the connection apparatus 110, the cutting apparatus 112 and the reject box 113.

One end of the connection apparatus 110 is connected with the discharging component 114, and a plurality of ends of the connection apparatus 110 are connected with the paper feed unit 15B of the image forming apparatus 2.

The connection apparatus 110 comprises a sheet detection sensor 110A. The erasing apparatus 1 sends a content that the entrance of a sheet is detected to the image forming apparatus 2 when the sheet detection sensor 110A detects the entrance of a sheet.

The erasing apparatus 1 sends information denoting the end of the conveyance of the sheet to the image forming apparatus 2 in a condition that the sheet detection sensor 110A does not detect the sheet again.

The image forming apparatus 2 temporarily interrupts image formation in a condition that information denoting the entrance of a sheet is received from the erasing apparatus 1, and starts the image formation again after the information denoting the end of the conveyance of sheet is received.

The connection apparatus 110 can be configured to be a detachable unit. In such a condition, reuse box may be arranged in place of the connection apparatus 110, is not connected with the image forming apparatus 2.

The reuse box is a box accumulating the reusable sheet.

The erasing apparatus 1 comprises a shredder dust box 112A connected with the cutting apparatus 112. The cutting apparatus 112 accumulates shredder dust generated by the cutting on the sheet in the shredder dust box 112A.

The reject box 113 comprises a key limiting the internal access to the reject box 113.

The operation unit 128, for example, comprises a numeric keypad, a stop key, a start key and the like. A user instructs the function action of the erasing apparatus 1, such as the start of color erasing or the reading of the image of a sheet which is a subject to erase a color, through the operation unit. The operation unit 128 displays the setting information or the action status, the logo information of the erasing apparatus 1 or a message provided for the user. In addition, the operation unit 128 is not limited to be configured on the main body of the erasing apparatus 1. For example, it can be applied to the structure that an operator operates from an operation unit of an external apparatus connected with the erasing apparatus 1 through a network.

The image forming apparatus 2 comprises a control unit 200, a control panel 203, a start button 203A, an automatic manuscript conveying apparatus 11, an image reading unit 12, an image forming unit 13, a transfer unit 14, a paper conveying mechanism 18 and paper feed units 15A and 15B.

The control panel 203, for example, comprises a touch panel, and the touch panel is an input and output unit displaying a graphic user interface.

When the start button 203A is pressed down, the signal of the content that the image formation is started is sent to the control unit 200.

The automatic manuscript conveying apparatus 11 is arranged at the upper portion of a main body of the image forming apparatus 2 in an openable-closable manner. The automatic manuscript conveying apparatus 11 comprises a manuscript conveying mechanism taking the manuscript one by one out from the paper feed tray and conveying the manuscript to a paper discharge tray.

The automatic manuscript conveying apparatus 11 conveys the manuscript one by one to a manuscript reading unit of the image reading unit 12 by a manuscript conveyance function. In addition, it's also possible to open the automatic manuscript conveying apparatus 11 and put the manuscript onto the the manuscript table of the image forming unit 12.

The image reading unit 12 comprises a carriage with an exposing lamp exposing the manuscript and a first reflecting mirror, a plurality of second reflecting mirrors cooperating the movement of the carriage to act, a lens block and a CCD (Charge Coupled Device) of an image reading sensor.

The carriage stills at the manuscript reading unit or reciprocates below the manuscript table and reflects the light of the exposing lamp, which is reflected by the manuscript, on the first reflecting mirror. The plurality of second reflecting mirrors reflect the reflected light of the first reflecting mirror on the lens block. The lens block changes the multiplying power of the reflected light, and outputs the multiplying power of the reflected light to the CCD. The CCD converts incident light into an electric signal and outputs the electric signal as an image signal to the image forming unit 13.

The image forming unit 13 comprises a laser irradiating unit 20A for each of a yellow Y, a magenta M, a cyan C, a black K and a color-erasable developing material E, a photosensitive drum 20B as an electrostatic latent image carrier, and a developing material supplying unit 20C.

The color-erasable developing material includes a color generation compound, a color developing agent and a color erasing agent. For the color generation compound, for example, a leuco dye can be listed. For the color developing agent, for example, a phenol group can be listed. For the color erasing agent, a substance which compatibilizes with the color generation compound when being heated, and moreover, does not have affinity with the color developing agent can be listed.

The color-erasable developing material develops the color by the interaction of the color generation compound and the color developing agent, and as the interaction between the color generation compound and the color developing agent is eliminated by the heating above a color erasing temperature, the color-erasable developing material is subjected to the color erasing.

The laser irradiating unit 20A irradiates laser to the photosensitive drum 20B based on the image signal, and forms an electrostatic latent image on the photosensitive drum 20B. The developing material supplying unit 20C supplies the developing material to the photosensitive drum 20B, and forms a developing material image based on the electrostatic latent image.

The transfer unit 14 comprises a transfer belt 14B and a transfer roller 14A. The transfer belt 14B as an image carrier transfers and carries the developing material image of the photosensitive drum 2013. The transfer roller applies a voltage, so as to transfer the developing material image of the transfer belt on a conveyed record medium.

The image forming apparatus 2 comprises a fixing apparatus 14C at the downstream side of the record medium conveyance direction of the transfer unit 14. The fixing apparatus 14C heats and pressurizes the developing material image, so as to fix the developing material image on the record medium.

The record medium P discharged from a paper discharge port is stowed on the paper discharge tray 16, namely, a carrying unit carrying the record medium.

The paper feed units 15A and 15B take the record medium one by one out from a paper feed cassette and hand over the record medium to the paper conveying mechanism. The paper conveying mechanism conveys the record medium to the transfer unit 14.

FIG. 2 is a block diagram illustrating configurations of the erasing apparatus 1. As shown in FIG. 2, the erasing apparatus 1 comprises the control unit 101 including a CPU as an arithmetic apparatus, the storage unit 310 such as a hard disk drive, a non-volatile memory and the like, a detecting unit 312 as a sensor detecting the sheet, a conveying unit 316 conveying the sheet, the cutting apparatus 112 such as a shredder and the like, the connection apparatus 110, a memory 314 such as a ROM, a RAM and the like, the operation unit 128 as the input and output apparatus, such as the control panel and the like, the reading unit 106, the erasing unit 108 and an interface 318 carrying out communication with the external apparatus.

The control unit 101 reads out a program stored in the storage unit 310 and executes the program.

The control unit 101 judges the category of the sheet based on the output of the reading unit 106. The control unit 101 displays the information on the operation unit 128 according to the judged category of the sheet, and controls the conveying unit 316 to convey the sheet to the cutting apparatus 112 in a condition that the sheet is to be cut, to convey the sheet to the connection apparatus 110 in a condition that the sheet is to be reused, and to convey the sheet to the reject box 113 in a condition that the sheet is judged to be not-reusable.

The erasing apparatus 1 is connected with a computer 220, namely the external apparatus and the image forming apparatus 2 through the interface 318.

The image forming apparatus 2 comprises a main CPU 201 which is the arithmetic apparatus of the control unit 200 uniformly controlling the entire image forming apparatus 2, the control panel 203 connected with the main CPU 201, a ROM and a RAM 202A as storage apparatuses, a hard disk drive 202B, the start button 203A, and an image processing unit 204 carrying out image processing.

The main CPU 201 is connected with the computer 220 which is an external apparatus through an interface 213. In addition, the main CPU 201 is connected with a printing CPU 205 controlling each portion of an image forming system, a scanning CPU 209 controlling each portion of an image reading-in system, and a driving controller 212 controlling a driving unit.

The printing CPU 205 controls a printer engine 206 forming the electrostatic latent image on the photosensitive drum 20B and a processing unit 207 forming the developing material image.

The scanning CPU 209 controls a CCD driving circuit 210 driving a CCD 211. The signal from the CCD 211 is output to the image forming unit 13.

Figure 3:
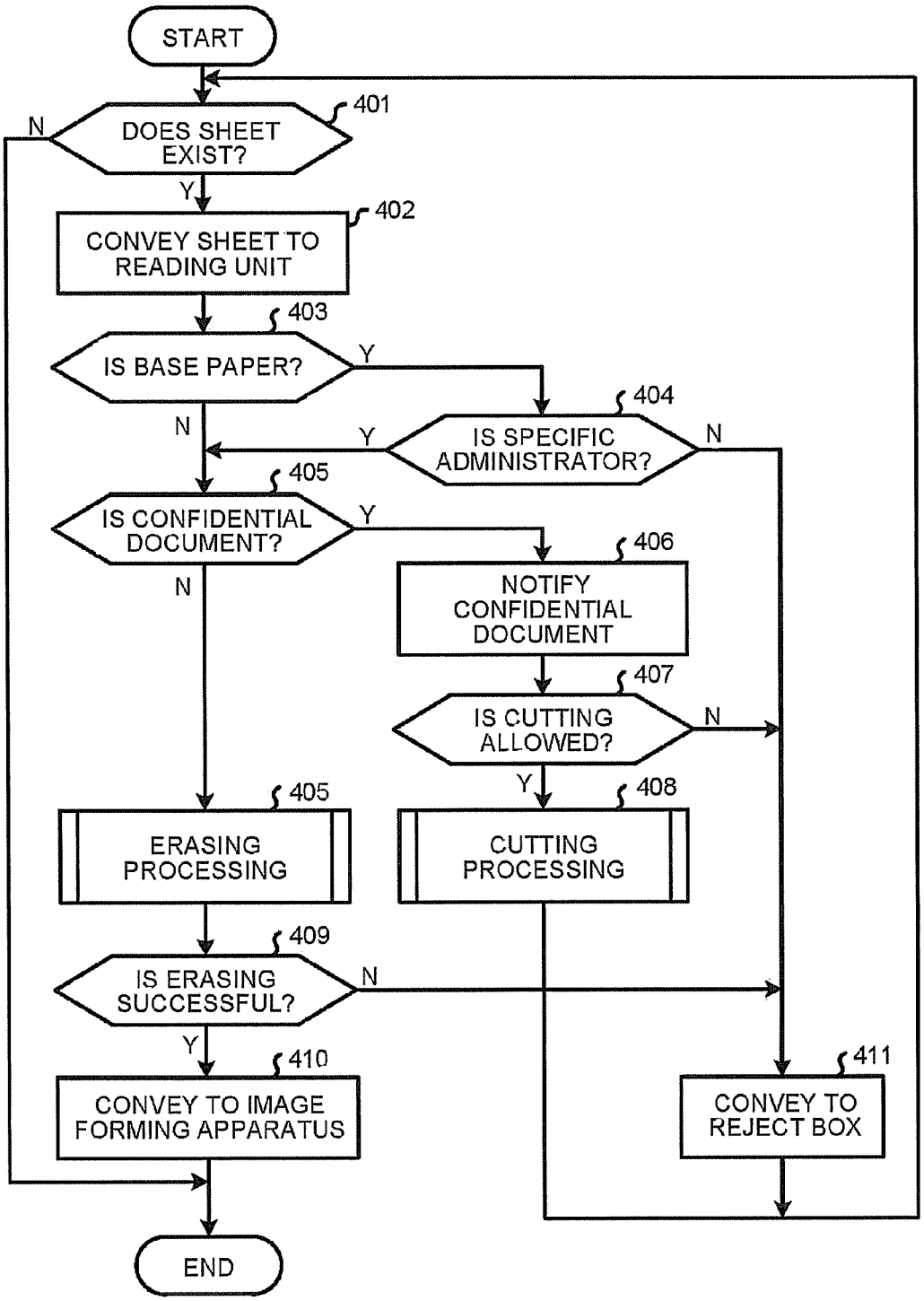
FIG. 3 is a flow chart illustrating the actions of the erasing apparatus.

FIG. 3 is a flow chart illustrating the actions of the erasing apparatus 1. As shown in FIG. 3, the erasing apparatus 1 judges the existence of the sheet on the paper feed tray 102 in ACT 401. The erasing apparatus 1 proceeds to ACT 402 in a condition that the sheet is judged to exist on the paper feed tray 102, and the erasing apparatus 1 ends the processing in a condition that the sheet is judged not to exist.

In ACT 402, the erasing apparatus 1 conveys the sheet to the reading unit 106.

In ACT 403, the erasing apparatus 1 judges whether or not the sheet is base paper. For the judgment, the judgment is carried out by carrying out the image processing on the image read by the reading unit 106 and judging the existence of a character or an image such as "Manuscript", "Base paper", "Original" in the image.

For the image processing, the algorithm of a known OCR program can be used, but a method for the image processing is not limited to that.

The erasing apparatus 1 judges that the sheet is the base paper in a condition that the character or the image mentioned above are judged to exist.

In addition, the erasing apparatus 1 judges that the sheet is not the base paper in a condition that the character or the image such as "COPY", "Duplication" are judged to exist in the image.

The erasing apparatus 1 proceeds to ACT 404 in a condition that the sheet is judged to be the base paper, and proceeds to ACT 405 in a condition that the sheet is judged not to be the base paper.

In ACT 404, the erasing apparatus 1 judges whether or not an operator is a specific administrator. The erasing apparatus 1 carries out displaying in a manner of inputting an ID on the operation unit 128.

The erasing apparatus 1 sets an ID table storing a list of the ID of the specific administrator in the storage unit 310.

The erasing apparatus 1 retrieves the ID table based on the input ID in a condition that the ID is input, and judges that the operator is the specific administrator in a condition that the input ID is stored in the ID table.

The erasing apparatus 1 proceeds to ACT 405 in a condition that the operator is judged to be the specific administrator, and proceeds to ACT 411 in a condition that the operator is judged not to be the specific administrator.

In ACT 405, the erasing apparatus 1 judges whether or not the sheet is the confidential document. For the judgment, the judgment is carried out by carrying out the image processing on the image read by the reading unit 106 and judging the existence of the character or the image such as "Secret", "Company Secret", "Confidential" in the image.

For the image processing, the algorithm of the known OCR program can be used, but the method for the image processing is not limited to that.

The erasing apparatus 1 judges that the sheet is the confidential document in a condition that the character or the image mentioned above are judged to exist.

The erasing apparatus 1 proceeds to ACT 406 in a condition that the sheet is judged to be the confidential document, and proceeds to ACT 405 in a condition that the sheet is judged not to be the confidential document.

In ACT 405, the erasing apparatus 1 conveys the sheet to the erasing unit 108 and carries out the erasing processing.

In ACT 406, the erasing apparatus 1 displays such a content that the sheet is the confidential document on the operation unit 128, and induce operator to input whether or not the cutting is allowed.

In ACT 407, the erasing apparatus 1 judges whether or not the cutting is allowed. The erasing apparatus 1 proceeds to ACT 408 in a condition that the cutting is judged to be allowed, and proceeds to ACT 411 in a condition that the cutting is judged not to be allowed.

In ACT 408, the erasing apparatus 1 conveys the sheet to the cutting apparatus 112 and carries out cutting processing.

In ACT 409, the erasing apparatus 1 conveys the sheet to the reading unit 106 again, and judges whether or not the erasing of the image is successful. The erasing apparatus 1 judges that the erasing is successful in a condition that the image is judged not to exist based on the output of the reading unit 106, and judges that the erasing is unsuccessful in a condition that the image is judged to exist based on the output of the reading unit 106.

The erasing apparatus 1 proceeds to ACT 410 in a condition that the erasing of the image is judged to be successful, and the erasing apparatus 1 proceeds to ACT 411 in a condition that the erasing is judged to be unsuccessful.

In ACT 410, the erasing apparatus 1 conveys the sheet to the connection apparatus 110, and conveys the sheet to the image forming apparatus 2 through the connection apparatus 110, so as to end the processing.

In ACT 411, the erasing apparatus 1 conveys the sheet to the reject box 113.

As described above, the erasing apparatus 1 of the present embodiment comprises: the paper feed tray 102 configured to feed sheet; the reading unit 106 configured to read the image on the sheet; the erasing unit 108 configured to erase the image on the sheet; the connection apparatus 110 configured to convey the sheet judged to be reusable to the paper feed unit 15B of the image forming apparatus 2; the cutting apparatus 112 configured to cut the sheet allowed to be cut; the reject box 113 configured to accumulate the sheet which is judged to be not-reusable; the operation unit 128 configured to be used as the input and output apparatus; and the control unit 101 configured to judge the category of the sheet based on the output of the reading unit 106 and change the conveyance destination of the sheet according to the category of the sheet.

Therefore, the erasing apparatus 1 has an effect of being capable of distinguishing the base paper, the confidential document and the reusable sheet, so as to properly carry out the processing.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An erasing apparatus, comprising:

a paper feed tray configured to feed a sheet;

a reading unit configured to read an image on the sheet;

an erasing unit configured to erase the image on the sheet;

a cutting apparatus configured to cut the sheet allowed to be cut;

a reject box configured to accumulate the sheet which is judged to be not-reusable;

a control unit configured to judge the category of the sheet based on the output of the reading unit and change the conveyance destination of the sheet according to the category of the sheet; and an operation unit configured to input and output information, wherein the control unit displays such a content that the sheet is a confidential document on the operation unit in a condition that the category of the sheet is judged to be the confidential document based on the output of the reading unit, and cuts the sheet by the cutting apparatus after the allowance of the cutting is input.

2. The erasing apparatus according to claim 1, comprising:

a connection apparatus configured to convey the sheet to a paper feed cassette of an image forming apparatus, wherein the control unit conveys the sheet to the image forming apparatus through the connection apparatus in a condition that the category of the sheet is judged to be the reusable sheet based on the output of the reading unit.

3. The erasing apparatus according to claim 1, wherein the control unit erases the image on the sheet by the erasing unit in a condition that the category of the sheet is judged to be base paper rather than a confidential document based on the output of the reading unit.

4. The erasing apparatus according to claim 1, further comprising:

an operation unit configured to input and output the information; and an ID table configured to store the ID of a specific administrator, wherein the control unit retrieves the ID table based on the ID input from the operation unit in a condition that the category of the sheet is judged to be the base paper based on the output of the reading unit, and conveys the sheet to the reject box rather than to the erasing unit and the cutting apparatus in a condition that the input ID is judged not to be the ID of the specific administrator.

5. An erasing method, comprising:

judging the category of a sheet based on the output of a reading unit reading an image on the sheet; and conveying the sheet to anyone of an erasing unit erasing the image on the sheet, a cutting apparatus cutting the sheet and a reject box accumulating the sheet.

* * * * *